United States Patent [19]

Anderson

[11] 4,258,500

[45] Mar. 31, 1981

[54] MOVING TOY

[76] Inventor: Curry Anderson, P.O. Box 797, Williamson, W. Va. 25661

[21] Appl. No.: 929,894

[22] Filed: Aug. 1, 1978

[51] Int. Cl.[3] ..... A63H 11/00

[52] U.S. Cl. ..... 46/264; 46/132

[58] Field of Search ..... 46/264, 132

[56] References Cited

U.S. PATENT DOCUMENTS

| | | | |
|---|---|---|---|
| 1,828,288 | 10/1931 | Marx | 46/219 |
| 2,132,661 | 10/1938 | Temple | 46/45 X |
| 2,618,889 | 11/1952 | Wigal | 46/132 X |
| 2,779,127 | 1/1957 | Holman | 46/132 X |
| 2,807,117 | 9/1957 | Davies | 46/132 X |
| 3,503,152 | 3/1970 | Aoki et al. | 46/132 X |
| 3,638,354 | 2/1972 | Morrison | 46/132 |

*Primary Examiner*—F. Barry Shay

*Attorney, Agent, or Firm*—Daniel Jay Tick

[57] ABSTRACT

A moving toy climbs an upright surface via suction cups affixed to a housing and additional suction cups affixed to the free ends of crank shafts. The crank shafts are coupled to the ends of a drive shaft outside the housing and the drive shaft is driven by a motor coupled thereto in the housing.

2 Claims, 10 Drawing Figures

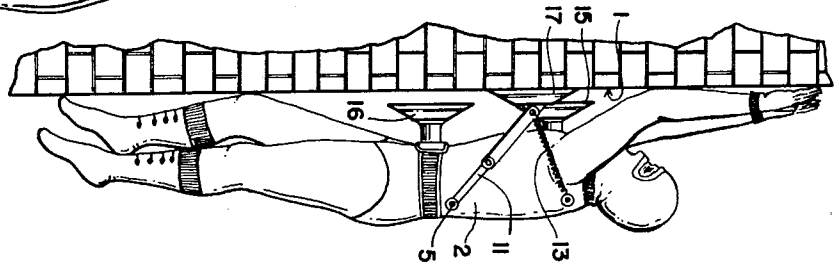
F I G. 1
F I G. 2
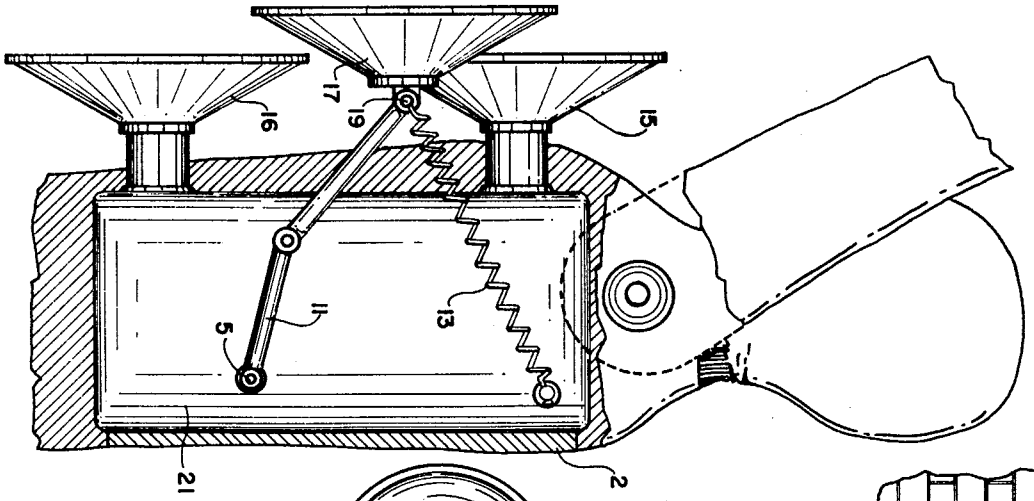
F I G. 3
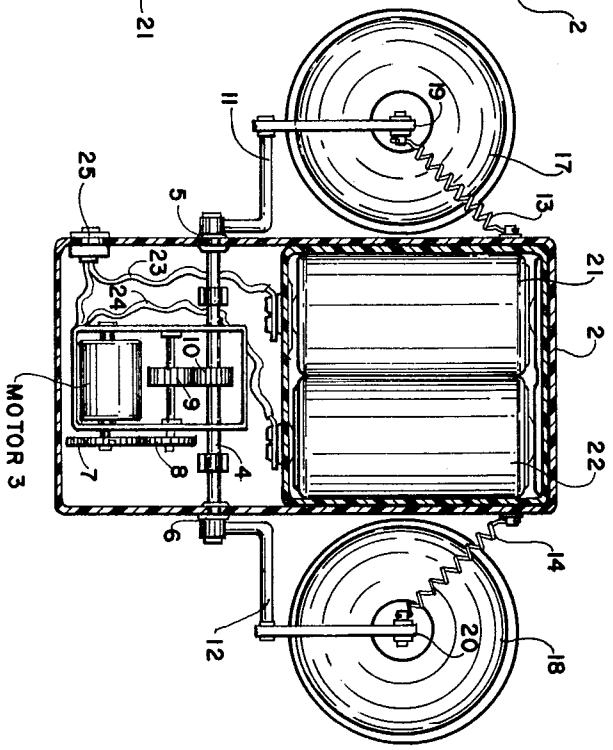

MOVING TOY

BACKGROUND OF THE INVENTION

The present invention relates to a moving toy. More particularly, the invention relates to a moving toy for climbing an upright surface.

Moving toys of the type described herein are disclosed in U.S. Pat. Nos. 1,828,288; 2,132,661; 2,618,889; 2,779,127; 2,807,117; 3,503,152; and 3,638,354.

Objects of the invention are to provide a moving toy of simple structure, which is inexpensive in manufacture, and functions efficiently, effectively and reliably to climb an upright surface thereby providing considerable amusement and interest to people of all ages.

BRIEF SUMMARY OF THE INVENTION

In accordance with the invention, a moving toy for climbing an upright surface, comprises a housing. A miniature motor is mounted in the housing. A drive shaft extends through the housing and extends out of the housing at spaced opposite ends thereof. A coupling device in the housing couples the motor to the drive shaft. Each of a pair of crank shafts is coupled to a corresponding end of the drive shaft outside the housing. Each of a pair of springs is coupled between the housing and a respective arm connected to the free end of a corresponding one of the crank shafts. Suction cups are affixed to the housing. Each of a pair of additional suction cups is affixed to the free end of a respective one of the arms. The housing, motor, drive shaft, crank shafts, arms, springs and suction cups are connected and arranged in a manner whereby operation of the motor rotates the drive shaft and moves the crank shafts and arms in predetermined rotary cycles to move the pair of additional suction cups into engagement with an upright surface at predetermined times thereby moving the housing outward from the surface to disengage the housing suction cups from the surface, then moving the housing upward on the surface and back inward toward the surface for re-engagement of the housing suction cups therewith. The springs subsequently move the pair of additional suction cups off the surface.

BRIEF DESCRIPTION OF THE DRAWINGS:

In order that the invention may be readily carried into effect, it will now be described with reference to the accompanying drawings, wherein:

FIG. 1 is a view of an embodiment of the moving toy of the invention climbing an upright surface;

FIG. 2 is a view, on an enlarged scale, partly cutaway and partly in section, of part of the moving toy of the invention;

FIG. 3 is a view, on an enlarged scale, of the essential operating components of the moving toy of the invention;

DETAILED DESCRIPTION OF THE INVENTION

The moving toy of the invention climbs an upright surface 1, as shown in FIG. 1.

The moving toy of the invention comprises a housing 2 (FIGS. 1 to 10). The housing 2 is preferably embedded in, or in the shape of, a miniature figure, in order to enhance the interest of the onlookers.

A miniature electric motor 3 is mounted in the housing 2, as shown in FIG. 3. Although the motor 3 is an electric motor in the disclosed embodiment of the invention, it may be a windup spring motor or other suitable type of miniature motor.

Figure 4:
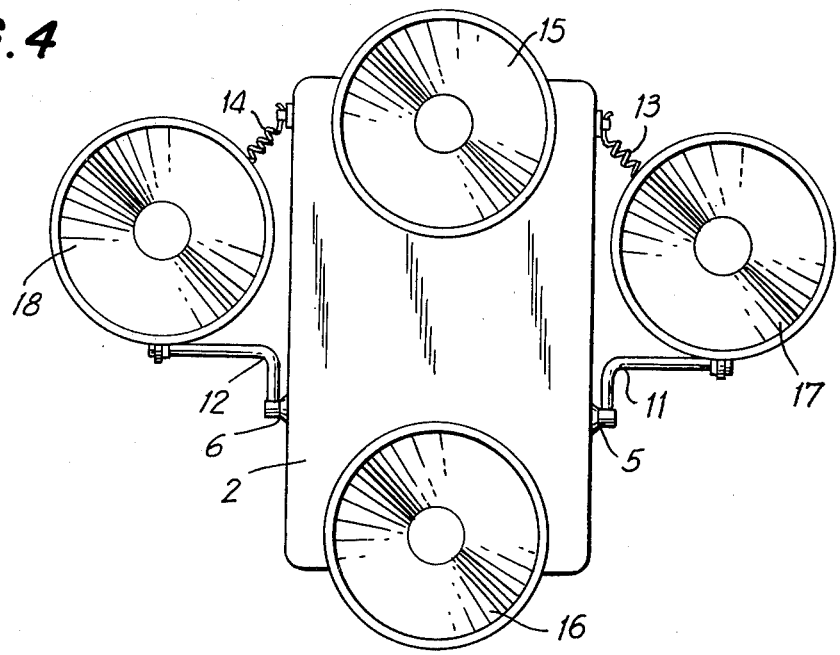
FIG. 4 is a view, on an enlarged scale, of the suction cups of the moving toy of the invention.

A drive shaft 4 extends through the housing 2, as shown in FIG. 3, and extends out of said housing at spaced opposite ends 5 and 6 thereof (FIGS. 3 and 4).

The motor 3 is coupled to the drive shaft 4 in the housing 2 via a coupling arrangement consisting of a gear train 7, 8, 9, 10, as shown in FIG. 3.

A pair of crank shafts 11 and 12 (FIGS. 3 and 4) are coupled to the ends 5 and 6, respectively, of the drive shaft 4 outside the housing 2, as shown in FIG. 3.

A pair of springs 13 and 14 (FIGS. 3 and 4) are coupled between the housing 2 and the crank shafts 11 and 12, respectively, as shown in FIG. 3.

Suction cups 15 and 16 are affixed to the housing 2, as shown in FIGS. 1, 2 and 4 to 10.

A pair of additional suction cups 17 and 18 (FIGS. 3 and 4) are affixed to the free ends 19 and 20, respectively, of the crank shafts 11 and 12, respectively, as shown in FIG. 3.

A battery or batteries 21 and 22 of any suitable type, such as, for example, rechargeable storage batteries, are mounted in the housing 2, as shown in FIG. 3, and are electrically connected to the motor 3 via electrical conductors 23 and 24, as shown in FIG. 3, for energizing said motor. The control of the energization and deenergization of the motor 3 is accomplished by a switch 25 (FIG. 3) electrically connected to the electrical conductors 23 and 24 and mounted on the outside of the housing 2.

Operation of the motor 3 rotates the drive shaft 4 and moves the crank shafts 11 and 12 in predetermined rotary cycles to move the additional suction cups 17 and 18 into contact with the upright surface 1 at predetermined times thereby moving the housing upward on said surface. The springs 13 and 14 move the additional suction cups 17 and 18 off the surface 1 after they have adhered sufficiently to move the toy forward.

The toy of the invention is able to climb up and down upright surfaces such as, for example, vertical surfaces. The center of gravity is positioned high in the hollow miniature figure. The springs 13 and 14, by moving the suction cups 17 and 18 off the surface 1, provide a reciprocating movement of said suction cups in limited arcs.

The suction cup 17, as is the suction cup 18 (not shown in FIGS. 5 to 10), is either placed on the surface 1 or is removed from such surface, in accordance with the rotation of the crank shaft 11. The drive shaft 4 ends 5 and 6 are indicated as O in FIGS. 5 to 10. The crank shaft 11 has an end P and the arm 26 thereof has an end Q (FIGS. 5 to 10). The spring 13 is affixed to the housing 2 at a point S (FIGS. 5 to 10).

The crank shaft 11 rotates its end P counterclockwise about the end O of the drive shaft 4 and imparts a reciprocating arcing movement to the end Q of the arm 26 about the point S. The range of motion of the end Q of the arm 26 is equivalent to the length of the spring 13 (FIGS. 5 to 10).

Figure 6:
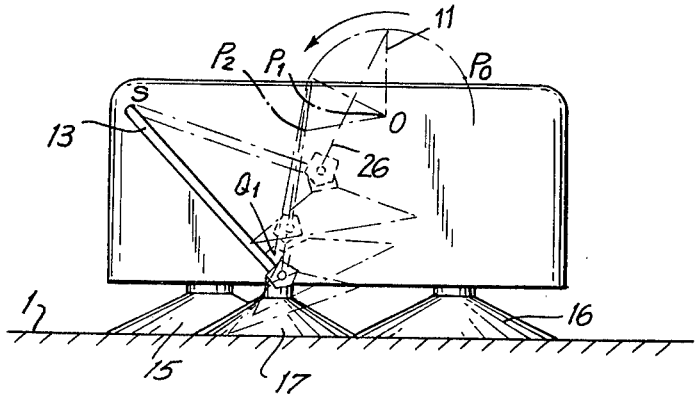
Figure 7:
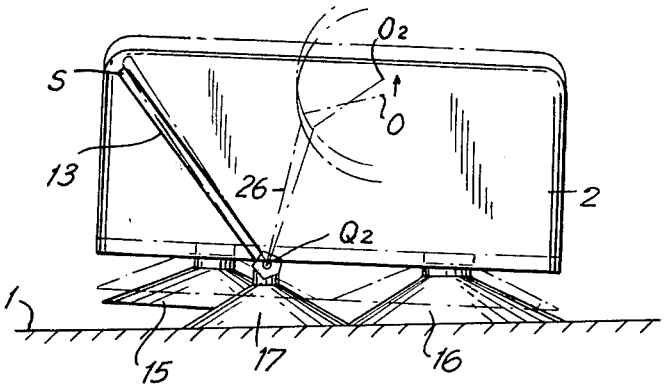
Figure 10:
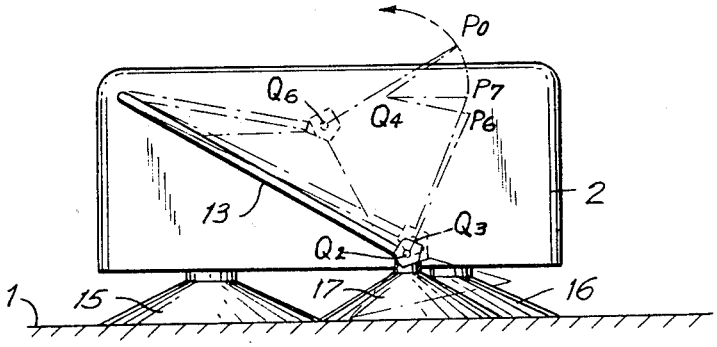

The end Q of the arm 26 is at its lowest position when the end P is positioned at approximately 8:00 o'clock, as shown in FIGS. 6 and 7. The arm 26 positions the suction cup 17 outward at a point P1, which is its highest position, or farthest from the surface 1, at approximately 2:00 o'clock, as shown in FIG. 10.

Figure 5:
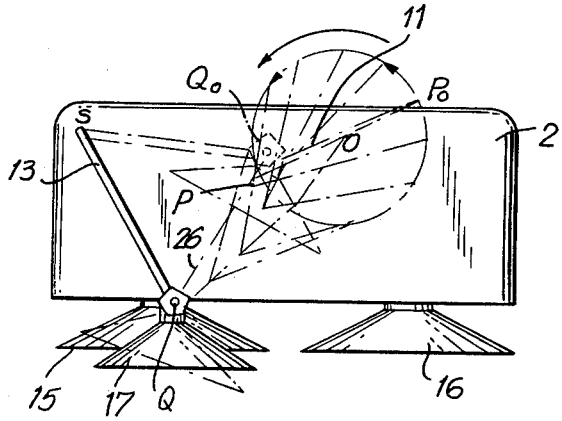
FIGS. 5, 6, 7, 8, 9 and 10 are schematic diagrams illustrating the movement of the moving toy of the invention.

When the toy is placed on the surface 1, as shown in FIG. 6, the suction cups 15 and 16 are placed on said surface. When the suction cup 17 is at its break-off position, which is when said suction cup pulls completely off the surface 1 and is at its highest point P0, Q0 off said surface, with the drive shaft 4 rotating counterclockwise, the crank shaft 11 moves its end P counterclockwise from P0 to P1 and moves the end Q of the arm 26 from Q0 to Q1, moving the suction cup 17 downward (FIGS. 5 and 6). Part of the suction cup 17 will engage the surface 1 when the ends P1, Q1 are at their positions shown in FIG. 6, to stabilize said suction cup on said surface.

Figure 8:
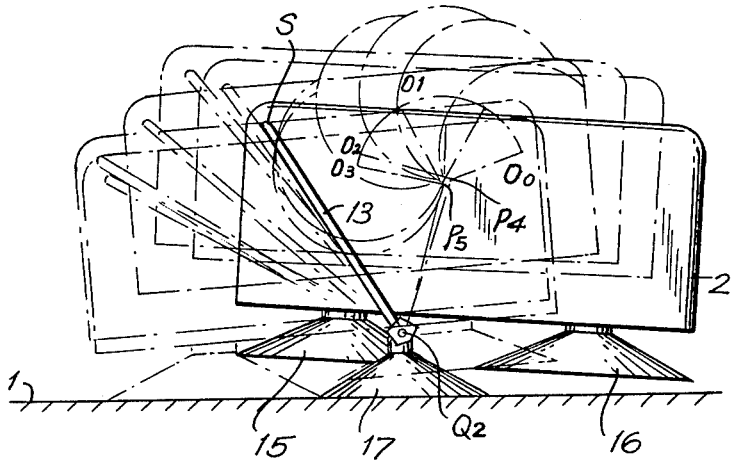

When the ends P2, Q2 are at their positions shown in FIG. 6, the spring 13 is slightly tensioned. When the cup 17 is solidly placed on the surface 1, the end Q of the arm 26 stops at its position Q2 and the end P of the crank shaft 11 moves from its position P3 to its position P4, as shown in FIG. 7. This causes the end of the drive shaft 4 to move slightly upward to a position Q0, against the force of the spring 13 and breaks the suction of the suction cups 15 and 16 (FIGS. 7 and 8). The suction of the suction cup 15 is broken first, due to the position of the drive shaft 4, the arm 26 and the suction cup 17 (FIG. 7).

The high center of gravity of the toy causes it to lean backwards, as shown in FIG. 7, when the suction cup 17 is solidly engaging the surface 1 and the suction cups 15 and 16 are spaced from said surface. The end Q of the arm 26 moves to its position Q2 and the end P of the crank shaft 11 moves the drive shaft 4 forward, thereby moving the housing 2 upward, as shown in FIG. 8. The spring 13 is then tensioned accordingly. However, when the end of the arm 26 moves from the position Q0 to the position Q1, the spring 13 contracts and causes the housing 2 to lean forward or inward, as shown in FIG. 8. At the position Q2 of the end of the arm 26, part of the suction cup 15 will engage the surface 1 (FIG. 8). At the position Q3 of the end of the arm 26, the entire suction cup 15 is in solid engagement with the surface 1, as shown in FIG. 10. The end of the crank shaft 11 will move slightly to a position P5 (FIGS. 8 and 9).

Figure 9:
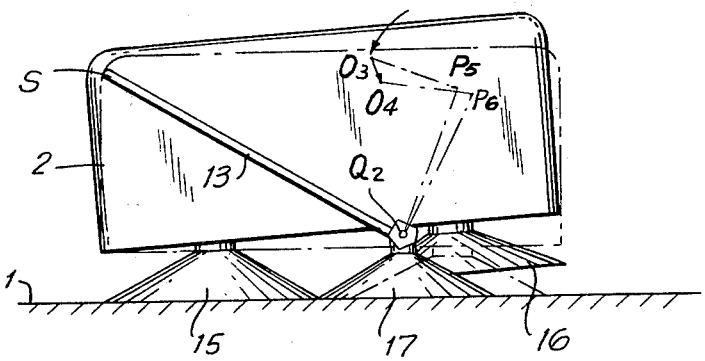

As shown in FIG. 9, movement of the ends of the drive shaft from a position O3 to a position O4 and movement of the end of the crank shaft 11 from a position P5 to a position P6 places the suction cup 16 on the surface 1, completing a cycle. Both cups 15 and 16 are then in solid engagement with the surface 1 and the end P of the crank shaft 11 moves counterclockwise from a position P6 to a postion P7, as shown in FIG. 10. The end Q of the arm 26 moves upward from the position Q2 to a position Q3 (FIG. 10), causing the suction cup 17 to move away from the surface 1 (FIG. 10). The end Q of the arm 26 is then forced to its farthest position Q0 from the surface 1, due to the continued movement of the crank shaft 11 and the pull from the contraction of the spring 13 (FIG. 10).

Repetition of the aforedescribed operation causes the toy to climb up or down the upright or vertical surface 1, as desired. The suction cups are smoothly moved into and out of engagement with the surface 1.

While the invention has been described by means of a specific example and in a specific embodiment, I do not wish to be limited thereto, for obvious modifications will occur to those skilled in the art without departing from the spirit and scope of the invention.

I claim:

1. A moving toy for climbing an upright surface, said moving toy comprising a housing;

a miniature motor mounted in the housing;

a drive shaft extending through the housing and extending out of the housing at spaced opposite ends thereof;

coupling means in the housing coupling the motor to the drive shaft;

a pair of crank shafts each coupled to a corresponding end of the drive shaft outside the housing;

a pair of springs each coupled between the housing and a respective arm connected to the free end of a corresponding one of the crank shafts;

suction cups affixed to the housing; and a pair of additional suction cups each affixed to the free end of a respective one of said arms, the housing, motor, drive shaft, crank shafts, arms, springs and suction cups being connected and arranged in a manner whereby operation of the motor rotates the drive shaft and moves the crank shafts and arms in predetermined rotary cycles to move the pair of additional suction cups into engagement with an upright surface at predetermined times thereby moving said housing outward from said surface to disengage the housing suction cups from said surface, then moving said housing upward on said surface and back inward toward said surface for re-engagement of said housing suction cups therewith, said springs subsequently moving said pair of additional suction cups off said surface.

2. A moving toy as claimed in claim 1, wherein the motor is an electric motor, and further comprising battery means in the housing electrically connected to said motor and energizing said motor.

* * * * *